US005255799A

United States Patent [19]

Haynes

[11] Patent Number: 5,255,799

[45] Date of Patent: Oct. 26, 1993

[54] PORTABLE BILLARD CUE HOLDER

[76] Inventor: Jerry D. Haynes, R.R. 2, Box 59A, Skiatook, Okla. 74070

[21] Appl. No.: 873,803

[22] Filed: Apr. 27, 1992

[51] Int. Cl.[5] ..... A47F 7/00

[52] U.S. Cl. ..... 211/68; 248/231.7

[58] Field of Search ..... 211/68, 65, 70.8, 89, 211/90; 248/231.7

[56] References Cited

U.S. PATENT DOCUMENTS

| | | | |
|---|---|---|---|
| 69,026 | 9/1867 | Richmond | 211/68 |
| 587,101 | 7/1897 | Lombard et al. | 211/90 |
| 617,221 | 1/1899 | Beattie | 211/68 |
| 1,174,185 | 3/1916 | Scott | 211/68 |
| 1,465,659 | 8/1923 | Wheeler | 248/231.7 X |
| 1,503,120 | 7/1924 | Drost | 211/68 |
| 3,365,761 | 1/1968 | Kalvig | 211/65 X |
| 3,487,947 | 1/1970 | Bogar, Jr. | 211/89 X |
| 3,603,551 | 9/1971 | Peterson | 211/89 X |
| 4,903,929 | 2/1990 | Hoffman | 248/231.7 X |
| 5,072,908 | 12/1991 | Lodrick | 211/68 X |

*Primary Examiner*—David A. Scherbel
*Assistant Examiner*—Derek J. Berger
*Attorney, Agent, or Firm*—Head & Johnson

[57] ABSTRACT

A portable holder for a billiard cue having a base end and a shaft. The portable holder includes a clamp for removable attachment to a table, ledge or the like. A flexible resilient member is capable of surrounding the circumference of the shaft, so that the base end of the cue may be placed on a floor or other surface and the shaft of the cue may be inserted into the member for retention.

6 Claims, 3 Drawing Sheets

PORTABLE BILLARD CUE HOLDER

BACKGROUND OF THE INVENTION

1. Field of the Invention.

The present invention relates to a portable holder for billiard cues. In particular, the present invention relates to a portable holder for billiard cues that may be detachably connected to a table, ledge, or the like.

2. Prior Art.

While only a single billiard cue or pool stick is necessary to play billiards, billiard players are predisposed to their own favorite cues for a variety of reasons. Increasingly, these cues have fancy and elaborate finishes and include coatings and inlays of precious and rare materials. The cues may be easily scratched or damaged. For these reasons, the cues must be handled and stored carefully.

Stationery and wall mounted cue holders are well known. Denton et al (#4,275,816), Worden (#481,455), and Richmond (#69,026) are illustrative of these types of cue holders. While these holders serve their purpose, they have limitations. These holders may not be located near the area of play. Additionally, when players bring their own cues to a match, the stationery holder may not accommodate the number of cues.

Cues are oftentimes rested upright with one end of the floor and the shaft or other end against a wall, table, chair or the like.

Lodrick (U.S. Pat. No. 5,072,098) discloses a removable holder to retain a pool cue in an upright position with its butt end on the floor. The holder may be releasably mounted on any support surface such as a table or a bar. While Lodrick provides support members to support the cue, since the shaft is not surrounded, a jarring force on the cue could knock the cue over. Additionally, no provision in the holder is made to cushion the cue from scratches or damage.

Accordingly, there exists a need to provide a portable cue holder that may be transported to a desired site and may be detachably connected to nearly any flat surface for securely retaining a pool cue without scratching, marring or otherwise damaging the cue shaft.

It is a principal object and purpose of the present invention to provide a portable cue holder that may be detachably connected to nearly any flat surface.

It is a further object and purpose of the present invention to provide a portable cue holder that is simple and easy to manufacture and assemble.

It is an additional object and purpose of the present invention to provide a portable cue holder that is durable and of high quality yet is attractive and pleasing to the eye.

SUMMARY OF THE INVENTION

A portable billiard cue holder is provided which may be secured to a table, ledge or nearly any structure having a flat surface.

The billiard cue holder includes a pair of clamping mechanisms. Each clamping mechanism includes a jaw with an adjustable screw. When the holder is installed, the table or other flat surface to which it is secured may abut a sidewall of the jaw.

The holder includes a cue retainer assembly. The retainer assembly includes a lower rigid plate and a parallel upper plate. The lower plate would rest on the top surface of the table. Sandwiched between the plates is a flexible, resilient member.

The retainer assembly has a front edge wherein a number of recesses are formed. The recesses each have a width larger than the diameter of the cue shaft. The flexible, resilient member extends out slightly into each of the recesses. Each recess is a corresponding circular aperture formed by the resilient member.

Within each recess, the flexible, resilient member extends into the recess to form a pair of opposed shoulders.

In order to utilize the device, a cue would be placed with its base on a floor or flat surface beneath the holder. The shaft of the cue would then be brought to the edge of the holder. The shaft would be pressed against the opposed shoulders which would resiliently move aside to form a passage for the cue shaft. Once the cue shaft was within an aperture, the shoulders would move back to their original position.

DETAILED DESCRIPTION OF THE PREFERRED EMBODIMENTS

Figure 1:
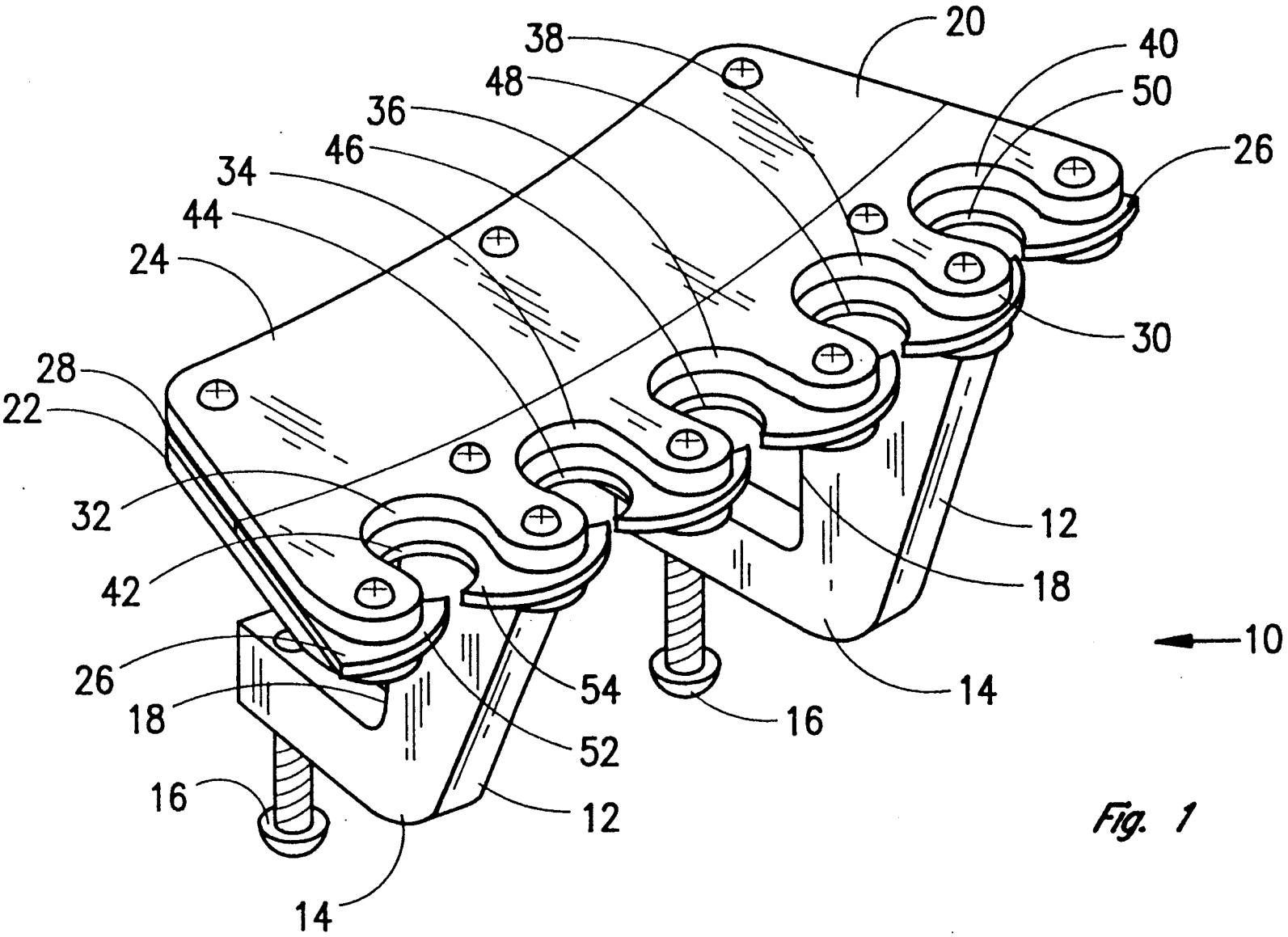
FIG. 1 is a perspective of a portable billiard cue holder constructed in accordance with the present invention.

Referring to the drawings in detail, FIG. 1 is a perspective view of a portable billiard cue holder 10. The billiard cue holder 10 has a pair of clamping mechanisms 12 so that the device may be secured to a table, ledge or nearly any structure having a flat surface.

While a pair of clamping mechanisms 12 are utilized in the present embodiment, it will be understood that a single clamping mechanism might be employed.

Each clamping mechanism includes a jaw 14 and an adjustable screw 16. Each jaw 14 is relatively wide so that the holder 10 may be utilized with various tables having any number of widths. In the present embodiment, the jaw will accommodate tables from one inch to four inches in width.

The holder 10 shown in FIG. 1 shown apart from the table and ready for installation. The jaw 14 and adjustable screw 16 may be constructed a variety of materials. It has been found, however, that a material such as a Lexan® or Plexiglas® is advantageous since it is lightweight for transportation of the holder yet will not scratch or mar a table or other surface.

The portable billiard cue holder 10 shown in FIG. 1 is designed to hold and retain five cues. It will be understood that the present invention can be constructed to hold any number of cues. It is believed that holders of between two and five cues are the most advantageous.

Each jaw 14 includes a sidewall 18. When the holder is installed, the table or other flat surface to which it is secured may abut the sidewall 18.

The holder 10 includes a cue retainer assembly 20. The retainer assembly 20 includes a pair of parallel or rigid plates, a lower plate 22 and an upper plate 24. The lower plate would rest on the top surface of the table or flat surface (not shown in FIG. 1). In the embodiment shown, the lower plate 22 would act in concert with the adjustable screw 16 of the clamping mechanism 12 to securely retain the holder. The upper plate 24 is also flat and rigid and has similar dimensions to the lower plate 22.

Sandwiched between the plates 22 and 24 is a flexible, resilient member 26. The flexible, resilient member may be continuous throughout the entire surface of the plates. Alternatively, a spacer member 28 may be juxtaposed between the 15 plates in the rear portion. The spacer member may have lettering or other indicia printed thereon which could be seen through the transparent upper plate. The holder could thus be personalized.

The retainer assembly 20 has the front edge 30 wherein a number of recesses 32, 34, 36, 38 and 40 are formed. The recesses have a width which is larger than the diameter of the shaft of the cue (not shown in FIG. 1). The recesses being adjacent to each other, a plurality of fingers are formed between the recesses.

The flexible, resilient member 26 extends out slightly into each of the recesses. Each recess has a corresponding circular aperture 42, 44, 46, 48 and 50 formed by the resilient member.

Within each recess, the flexible, resilient member 26 extends into the recess to form a pair of opposed shoulders 52 and 54 (as best seen in recess 32). The opposed shoulders are, thus, juxtaposed between the edge 30 and the recess. The resilient member is composed of a silicone rubber or other material that will not scratch, mar or otherwise damage the cue shaft.

In order to utilize the holder 10, the threaded screw 16 would be turned in counter-clockwise direction to open the clamping mechanism. The clamping mechanism and the lower plate 22 would then be placed over a flat surface such as a table or ledge. Each adjustable screw 16 would then be rotated clockwise to tighten the holder 10 to the flat surface.

A cue (not shown in FIG. 1) would be placed with its base or butt end on the floor or flat surface (not shown in FIG. 1) beneath the holder 10. The shaft of the cue would then be brought to the edge 30 of the holder. The shaft would be pressed against the shoulders 52 and 54 which would resiliently move aside to form a passage for the cue shaft. Once the cue shaft was within one of the apertures, the shoulders would resiliently move back to their original position.

The entire circumference of the cue shaft is, thus, surrounded and supported by the resilient member and is frictionally engaged therewith.

Figure 2:
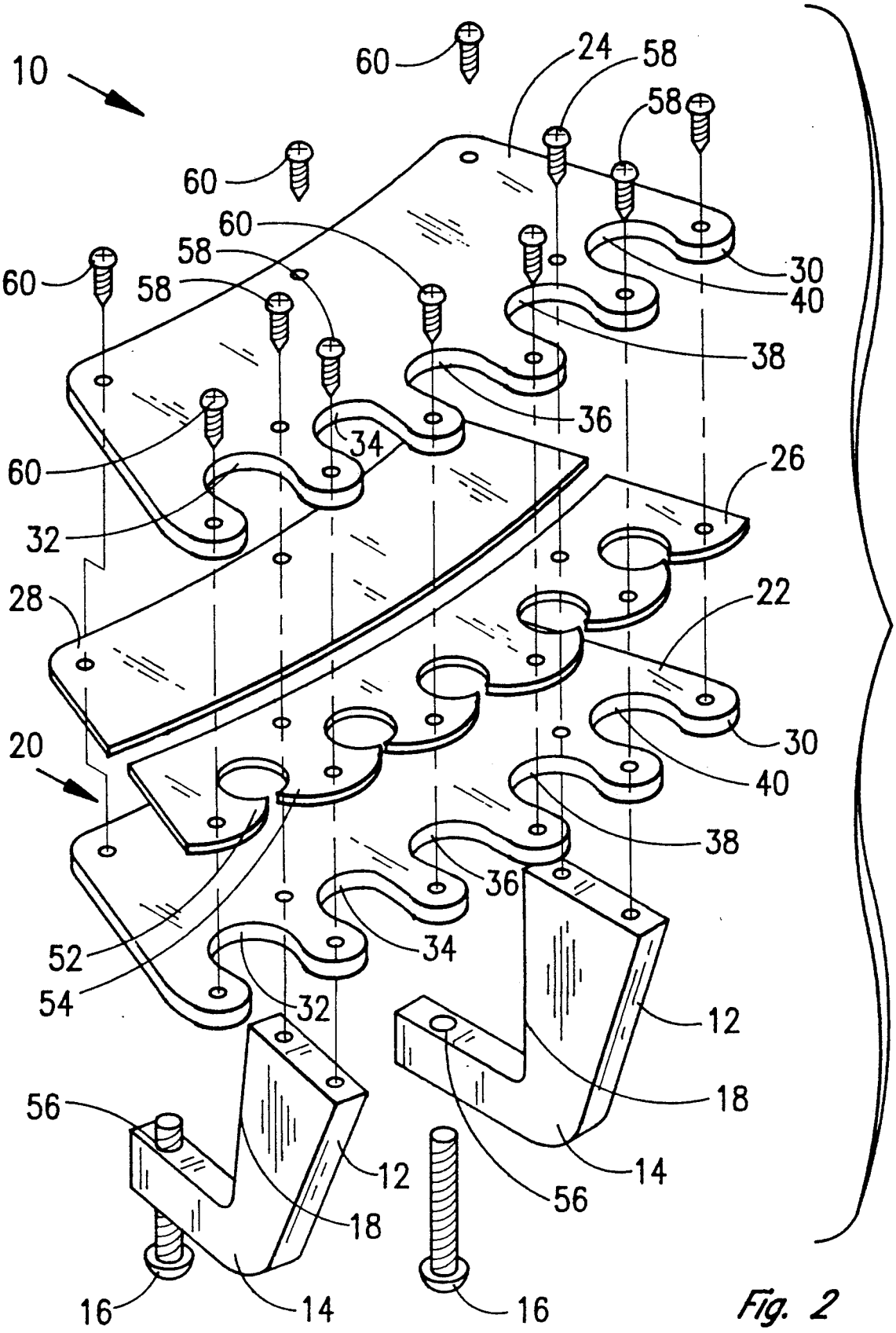
FIG. 2 is an exploded view of the portable billiard cue holder shown in FIG. 1.

FIG. 2 shows an exploded view of holder 10. Each adjustable screw 16 of the clamping mechanism is received through a threaded opening 56 in the jaw 14. The cue retainer assembly 20 is fastened to the clamping mechanism 12 through screws 58 which pass through openings in the upper plate 24, the resilient member 26 and the lower plate 22 and into the jaw 14. Other means of fastening the clamping mechanisms to the cue retainer assembly are, of course, possible.

Screws 60 pass through openings in the upper plate, resilient member and spacer member and into the lower plate holding the retainer assembly 20 together.

Figure 3:
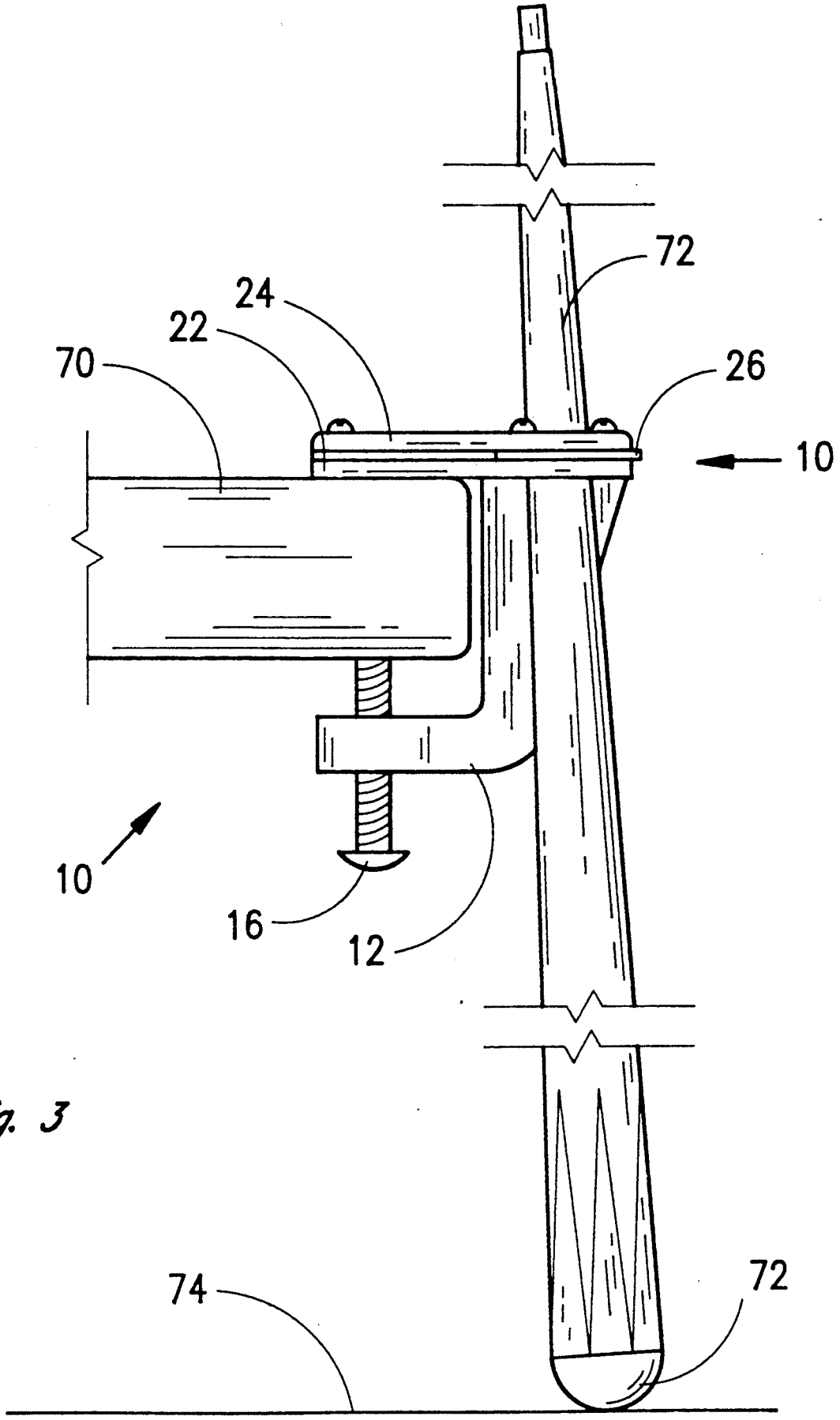
FIG. 3 is a side view of a portable billiard cue holder as seen in FIG. 1, shown attached to a table and retaining a cue therein.

FIG. 3 shows a side view of the billiard cue holder 10 installed on the edge of a table 70. A cue 72 is shown retained within the holder. The base end 74 of the cue is shown resting on the floor 76.

Whereas, the present invention has been described in relation to the drawings attached hereto, it should be understood that other and further modifications, apart from those shown or suggested herein, may be made within the spirit and scope of this invention.

What is claimed is:

1. A portable holder for at least one cue, said cue including a base end and a shaft having a circular cross-section, which holder comprises:

flexible, resilient retention means for surrounding the circumference of said shaft of said cue, said retention means including a pair of rigid parallel plates and a flexible, resilient member sandwiched therebetween;

at least a pair of clamps for removable attachment to a table, ledge or the like;

said clamps spaced from each other along said lower plate so that said lower plate will rest on said table, ledge or the like; and means to receive said shaft of said cue radially into said retention means wherein said base end of said cue may be placed on a floor or other surface and said shaft of said cue may be inserted to be retained in said retention means.

2. A portable holder for at least one cue as set forth in claim 1 wherein each said clamp includes at least one jaw and an adjustable screw to accommodate tables, ledges or the like having various widths.

3. A portable holder for a cue as set forth in claim 1 wherein said resilient member has a plurality of recesses, each recess having a width larger than the diameter of said shaft, and wherein said means to receive said shaft includes a pair of shoulders for each said recess forming a passage smaller than the diameter of said shaft, so that said shaft may be moved past said shoulders to insert said shaft in one of said recesses.

4. A portable holder for a cue as set forth in claim 1 wherein said plates have a plurality of extending fingers with space therebetween, said flexible resilient member extending into said spaces to form a plurality of receptacles for receiving said cues, each receptacle having a width larger than the diameter of said shaft.

5. A portable holder for at least one cue having a base and a shaft, which holder comprises:

at least a pair of adjustable clamps for removable attachment to a table, ledge or the like;

a plate extending between said pair of clamps so that said plate will rest on said table, ledge or the like;

an edge member having at least one recess therein said recess wider than the diameter of said shaft, said edge member composed of a flexible, resilient material; and a pair of opposed shoulders extending from said edge member into said recess so that said shaft of said cue may be moved laterally past said opposed shoulders to retain said cue in said recess.

6. A portable holder for a cue as set forth in claim 5 wherein said pair of opposed shoulders form a passage smaller than the diameter of said shaft.

* * * * *